US008024837B2

(12) United States Patent
Schroeter et al.

(10) Patent No.: US 8,024,837 B2
(45) Date of Patent: Sep. 27, 2011

(54) VACUUM CLEANER WITH A COVER RELEASE ELEMENT

(75) Inventors: Joerg Schroeter, Groebenzell (DE); Thomas Seith, Bad Neustadt (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1106 days.

(21) Appl. No.: 11/795,529

(22) PCT Filed: Dec. 7, 2005

(86) PCT No.: PCT/EP2005/056579

§ 371 (c)(1),
(2), (4) Date: Jul. 16, 2007

(87) PCT Pub. No.: WO2006/081890

PCT Pub. Date: Aug. 10, 2006

(65) Prior Publication Data

US 2008/0028569 A1 Feb. 7, 2008

(30) Foreign Application Priority Data

Jan. 31, 2005 (DE) ..... 10 2005 004 377

(51) Int. Cl.
*A47L 9/00* (2006.01)

(52) U.S. Cl. ..... 15/327.2; 15/327.7; 15/347

(58) Field of Classification Search ..... 15/327.7, 15/327.2, 347; *A47L 9/00*
See application file for complete search history.

(56) References Cited

U.S. PATENT DOCUMENTS

| | | | | |
|---|---|---|---|---|
| 3,530,784 | A | 9/1970 | Courchesne | |
| 4,928,347 | A * | 5/1990 | Krasznai et al. | 15/344 |
| 6,735,818 | B2 * | 5/2004 | Hamada et al. | 15/410 |
| 6,836,931 | B2 | 1/2005 | Bone | |
| 2004/0206238 | A1 * | 10/2004 | Allgeier | 95/273 |

FOREIGN PATENT DOCUMENTS

| | | | |
|---|---|---|---|
| CN | 2394546 | Y | 9/2000 |
| DE | 9107305 | U1 | 11/1992 |
| DE | 41 19 446 | | 12/1992 |
| DE | 94 05 010 | U | 7/1995 |
| DE | 198 04 621 | | 8/1999 |
| EP | 0 382 924 | | 8/1990 |
| EP | 0 997 098 | | 5/2000 |
| EP | 1 252 853 | | 10/2002 |
| WO | WO 2004/098367 | | 11/2004 |

OTHER PUBLICATIONS

International Search Report PCT/EP2005/056579.

* cited by examiner

*Primary Examiner* — David Redding
(74) *Attorney, Agent, or Firm* — James E. Howard; Andre Pallapies

(57) ABSTRACT

A vacuum cleaner comprising a housing, in which a dust collection chamber is arranged, which may be sealed by a dust chamber cover, on which an unlocking element for a clip element is provided, which cooperates with a counter-clip element on the housing, in order to hold the dust chamber cover in a closed position. According to the invention, a vacuum cleaner with improved cover lock may be achieved, whereby the unlocking element is integrated flush in the contour of the dust chamber cover and is embodied to be operated by pressing.

16 Claims, 5 Drawing Sheets

VACUUM CLEANER WITH A COVER RELEASE ELEMENT

Figure 1:
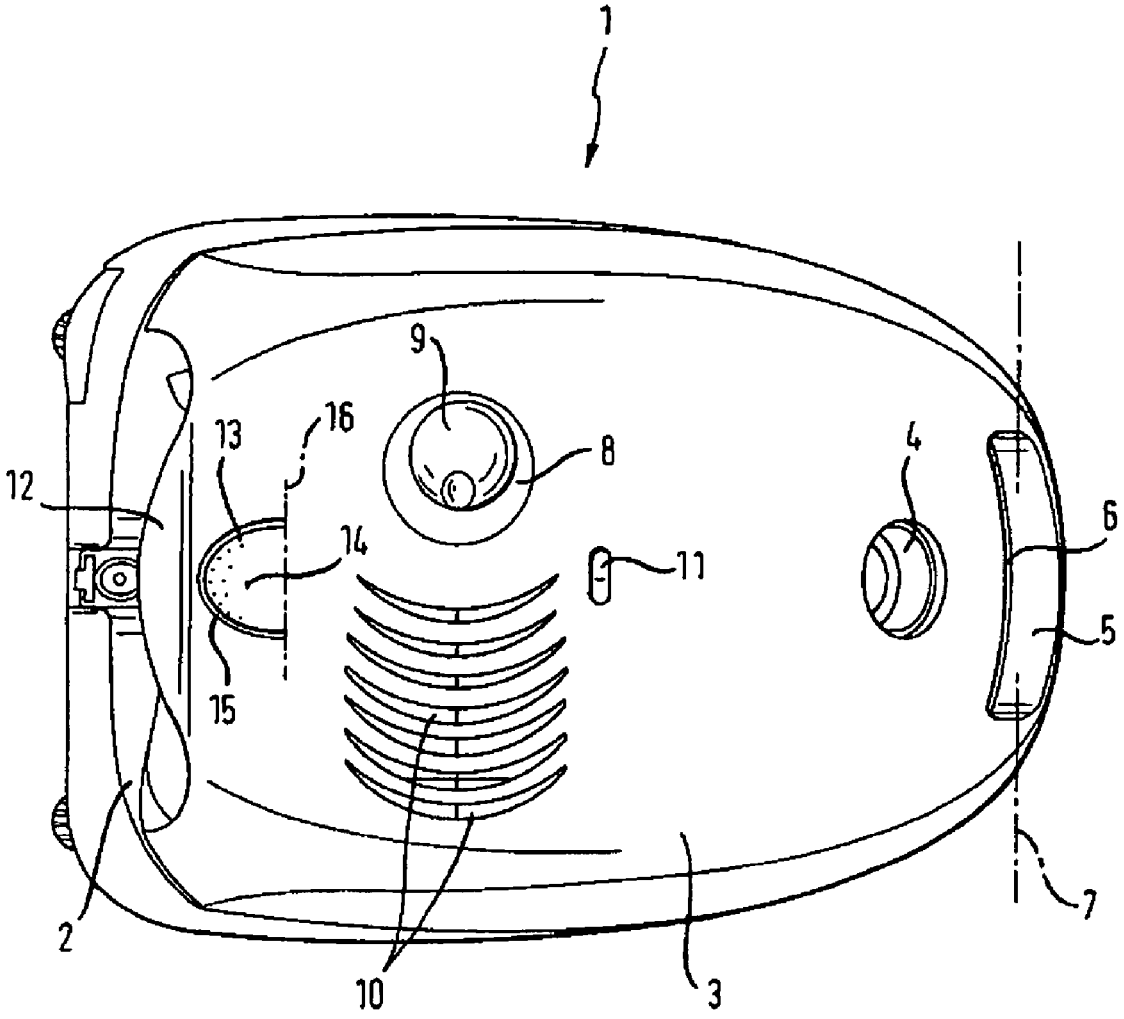

The invention relates to a vacuum cleaner as recited in the claims.

A vacuum cleaner which is currently on the market features a housing in which a dust collection chamber is arranged which is able to be sealed by a dust chamber cover which has a bar-type handle section to enable the vacuum cleaner to be carried around which borders a cutout in the dust chamber cover, into which a release element for a clip element protrudes which interoperates with a counter-clip element to hold the dust chamber cover in a closed position.

With this vacuum cleaner according to the prior art the dust chamber cover is supported to allow it to hinge on the housing. Opening the dust chamber cover provides access to the dust collection chamber to allow a full dust bag to be removed and a new dust bag to be inserted. At an end of the dust chamber cover opposite the hinge a bar-shaped handle is molded onto the dust chamber cover. To enable the bar-shaped handle to be gripped an opening is required in the wall of the dust chamber cover. A cover release element protrudes into the opening which, when actuated, actuates a clip element to enable the dust chamber cover to be opened.

The disadvantage of this prior art is however, that the grip opening must be made comparatively large. There are essentially two reasons for this. On the one hand the grip opening must be dimensioned so when the bar-type handle section is gripped, four fingers of a hand are able to grip through the opening. On the other hand the grip opening must be designed to be much larger than would be necessary to simply accommodate four fingers gripping the handle. It must namely be ensured that the cover release element is not inadvertently actuated and the clip element released when the fingers reach through the grip opening. The result of this would namely be that reaching with the hand through the grip opening to carry the vacuum cleaner would inadvertently release the dust chamber cover and the dust chamber cover would open while the vacuum cleaner is being carried.

The object of the invention is to create a vacuum cleaner with an improved cover locking mechanism.

This object is achieved in accordance with the invention for a generic vacuum cleaner by integrating the cover release element flush with the surface into the contour of the dust chamber cover and releasing the cover it by pressing on the element. The flush-fitting integration of the release element into the dust chamber cover on the one hand prevents an opening being needed in the dust chamber cover which could be used by the user as a handle and simultaneously offers a solution which can be manufactured at low cost in that the cover release element can be created in one operation when the dust chamber cover is being manufactured without having to be installed. The fact that a handle opening is done away with means that it is possible to ensure that, when the vacuum cleaner is being carried, the cover release element cannot be actuated inadvertently and the cover lock released. In accordance with the invention a carrying recess is then provided which can be gripped from behind with the fingers of one hand without having to reach through an opening in the dust chamber cover.

In the preferred embodiment of the invention the cover release element is embodied in one piece with the dust chamber cover. Cover release element and dust chamber cover can preferably be manufactured by injection molding as plastic parts. By directly forming the release element onto the dust chamber cover the diversity of parts at the manufacturer is reduced and an installation step for fitting the release element to the dust chamber cover can be dispensed with, which makes for cost-effective manufacturing of the vacuum cleaner.

The cover release element can be molded into a movable actuation tongue by leaving a separation gap on the dust chamber cover running over a part of its surface between cover release element and dust chamber cover. Despite the one-piece manufacturing the separation gap achieves a necessary movability of the cover release element and ensures a sufficiently firm connection to the dust chamber cover. To prevent material stresses or scratches the separating gap preferably runs in the shape of a parabola around the cover release element.

The separating gap can be selected to be very small. Alternatively, with larger gaps, a sealing insert made of soft plastic or elastomer can be inserted into the gap or injected directly in the two-component injection-molding process onto the dust chamber cover. The free edge of the cover release element could also engage behind the recess of the dust chamber cover such that the separating gap would be appear to the outside observer to be closed.

If the cover release element is embodied as an actuation tongue, this can be hinged around a base line in the transition area between cover release element and dust chamber cover. Preferably this transition area is embodied as type of film hinge. To embody the film hinge the thickness of the dust chamber cover wall can be reduced along this base line, which is preferably a chord line.

In a preferred embodiment the clip element is arranged on a side of the transition area opposite the actuation tongue, i.e. the base line or the chord line on the inner side of the dust chamber cover, and is able to be released by a least one projection on the inner side of the actuation tongue. Through this embodiment the clip element, which engages behind a counter-clip element on the housing, is separated constructively from the actuation element or the actuation tongue.

If a gap is left between clip element and projection, a design can be achieved in which a slight movement of the actuation tongue, for example by accidentally pressing lightly on the actuation tongue, does not release the dust chamber cover. In this case the actuation tongue can more or less hinge slightly, depending on the width of the gap, without touching the clip element. Only by pressing the actuation tongue further with a definite force is the clip element then released by means of the projection or the projections. This measure additionally prevents or at least renders more difficult an unintentional release of the cover locking.

If this additional safety is not required, for a precise actuation of the cover locking the clip element can be connected by a bar to the at least one projection. This constructive embodiment ensures that even a slight movement of the actuation tongue can bring about a release of the clip element. To guarantee that the actuation tongue is able to move, the bars are only provided in an upper end section between clip element and projection while a clear gap is maintained below the bars.

Preferably two projections are provided which are formed by two walls arranged in parallel to each other, between which the counter-clip element of the housing is positioned in a closed position of the dust chamber cover. This ensures that, even if the center of the cover release element is not pressed, the clip element is released evenly from the counter-clip element. This guarantees that the cover is reliably released even if pressed inappropriately by a user.

The dust chamber cover can optionally feature a handle section to allow the vacuum cleaner to be carried and extending between a free edge of the dust chamber cover and the cover release element. This handle section is preferably embodied as a carrying recess such that no opening is present through which the fingers of a hand can reach when the device is being carried. The inventive carrying recess is embodied so that the fingers of a hand in any event press from below against the actuation tongue of the unlocking element and thus tend to support the locking rather then being able to bring about an unintentional release.

The dust chamber cover can additionally feature at least one projection with a side edge which in the closed position of the dust chamber cover borders a retaining wall of the housing. This adjacency to the side edge to the retaining wall means that the dust chamber cover is additionally fixed such that a movement of the dust chamber cover is prevented which could have caused the clip or the teeth to be shaken out of the counter clip. This provides increased security against release of the cover locking.

Figure 2:
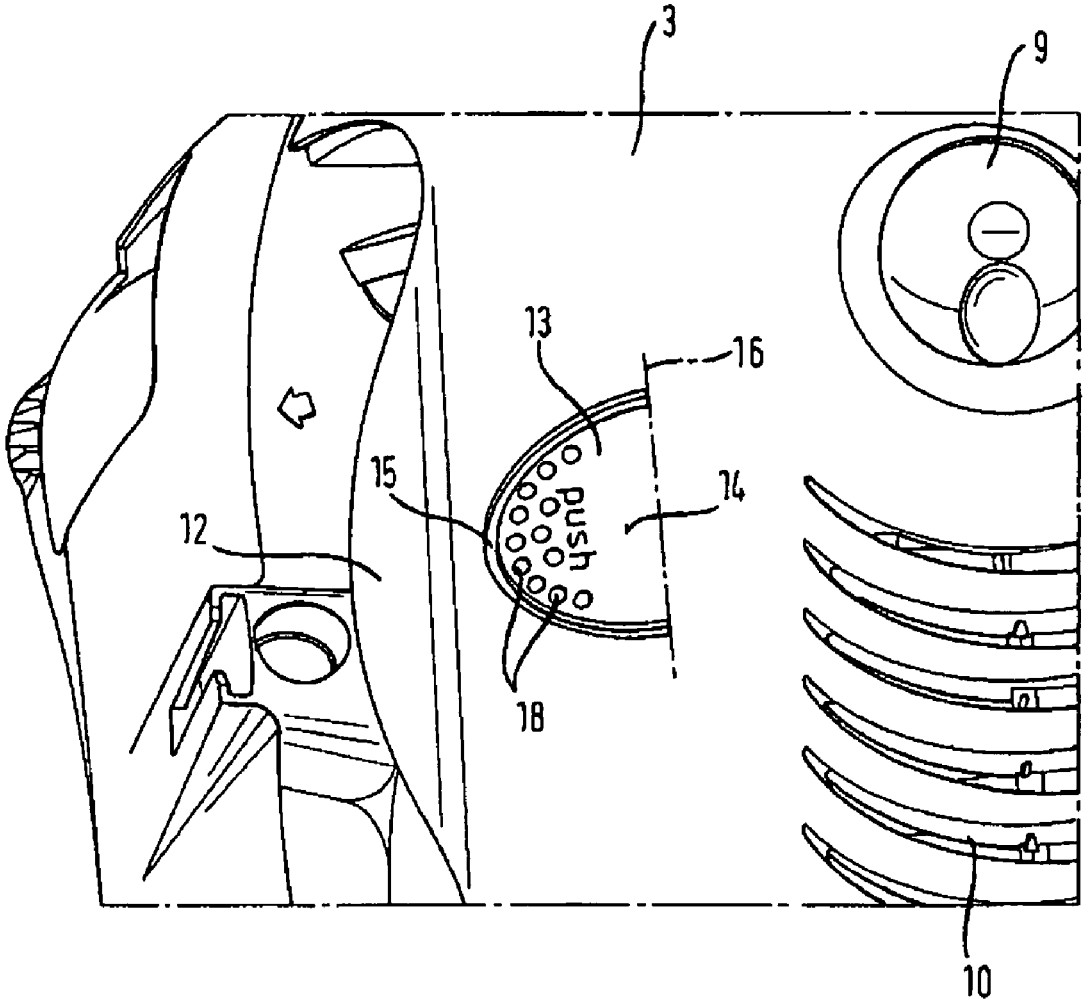
Figure 3:
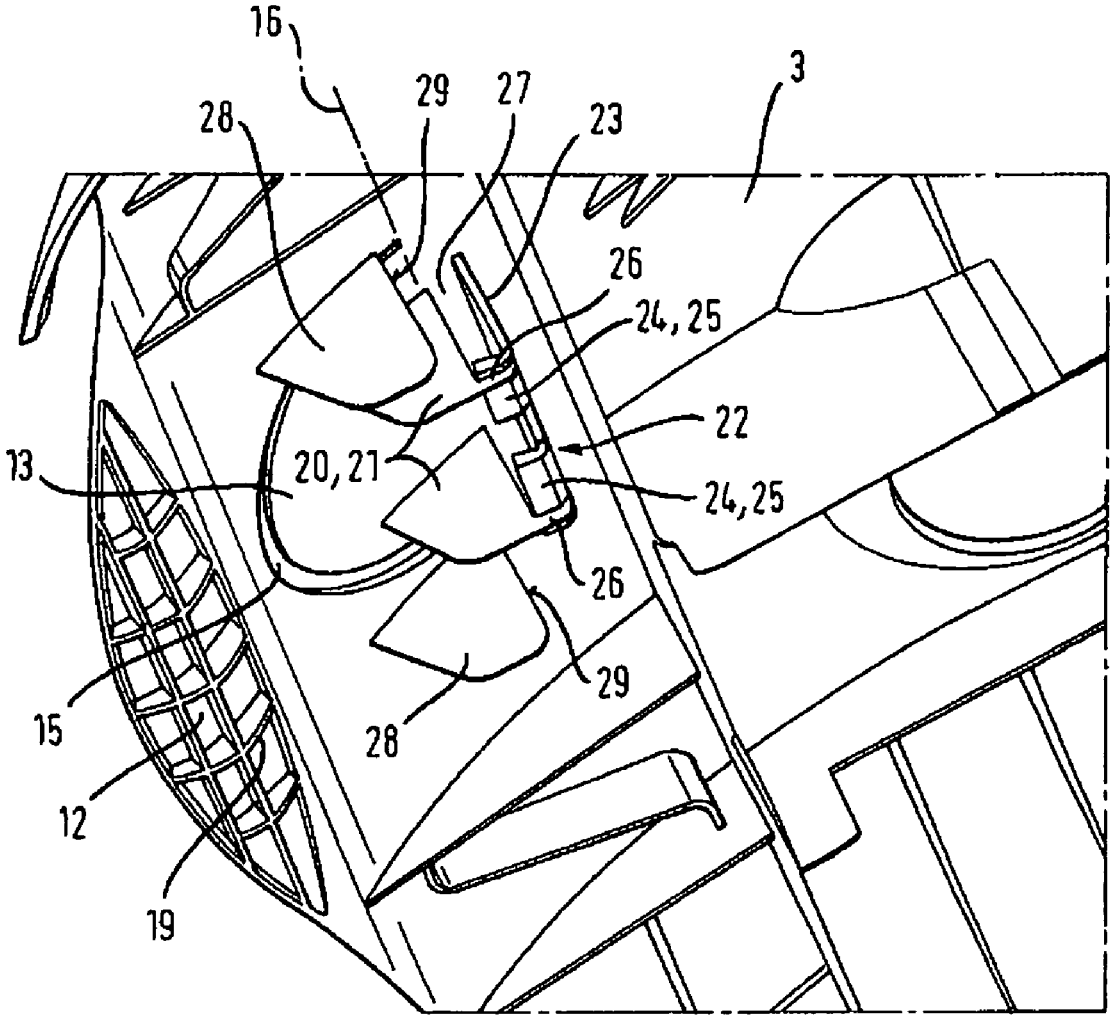
Figure 4:
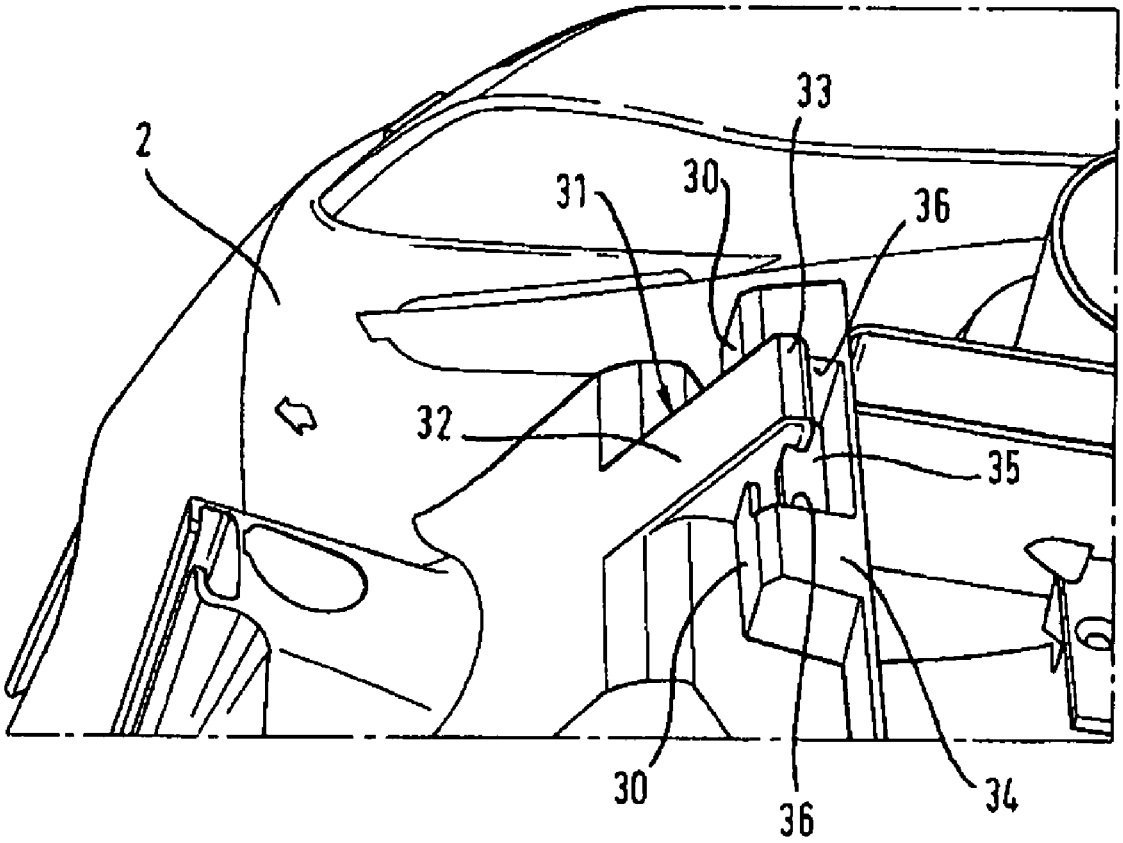
Figure 6:
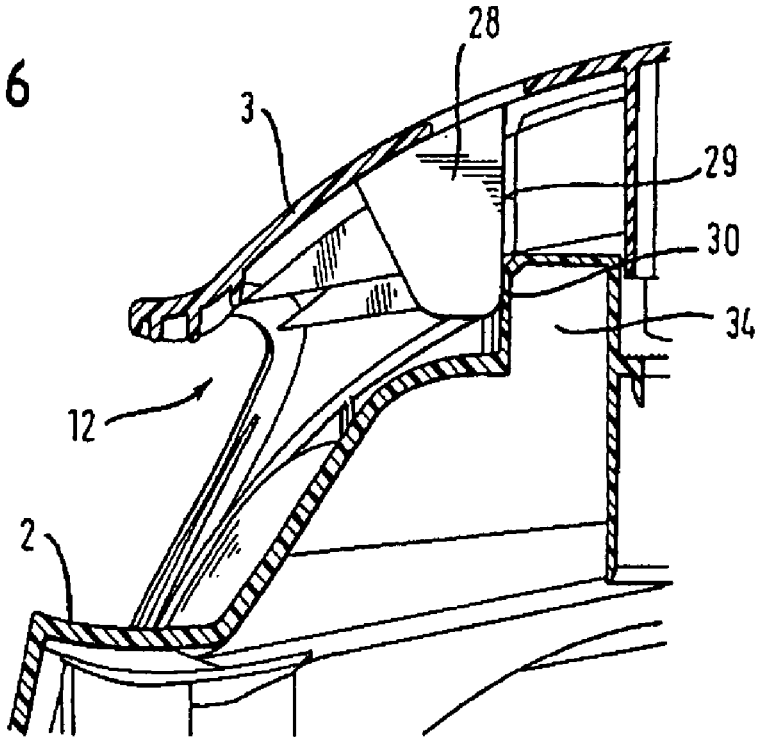
Figure 5:
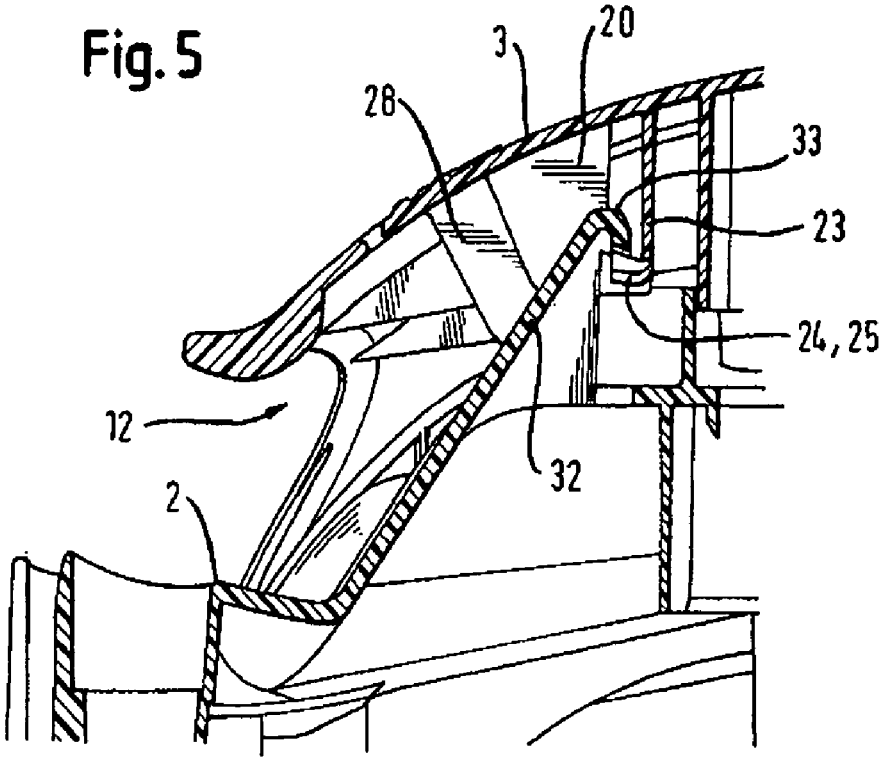

The figures show:

FIG. 1 an overhead view of a dust chamber cover of a vacuum cleaner with an inventive cover release element;

FIG. 2 a perspective view of a section of the dust chamber cover in accordance with FIG. 1 with integrated cover release element;

FIG. 3 a perspective view from below of a section of the dust chamber cover from FIG. 2 with integrated cover release element and a molded-on clip element;

FIG. 4 a perspective view of a section of the housing with a molded-on counter-clip element;

FIG. 5 a part sectional view through housing and dust chamber cover with the clip element from FIG. 3 and the counter-clip element from FIG. 4 in the closed position;

FIG. 6 a part sectional view through housing and dust chamber cover in a plane offset from the clip element and counter-clip element from FIG. 5.

A vacuum cleaner 1 viewed from above in FIG. 1 has a housing 2 which is closed off by a dust chamber cover 3. A suction opening 4 is made in the dust chamber cover 3, via which the dust-laden air is sucked in from a suction nozzle via a suction pipe and/or suction hose. The suction opening 4 is embodied for coupling a hose connection (not shown). In the vicinity of the suction opening 4 is a carrying handle 5 molded onto the dust chamber cover 3. The carrying handle 5 is formed into a yoke shape and delimits a grip opening 6 provided in the dust chamber cover 3, which is embodied in its position and size to allow four fingers of a hand to reach through it. The dust chamber cover 3 is supported around a pivot axis 7 to allow it to hinge on housing 2. The pivot axis 7 runs essentially parallel to the longitudinal extent of the carrying handle 5. The dust chamber cover 3, in addition to the suction opening 4, also bears a further circular cutout 8, which gives access to an actuation element 9 able to be rotated in the housing and pressed axially, for switching on and switching off as well as for power control. Running at least approximately coaxially to the center point of the circular breakthrough 8 are crescent-shaped ventilation slots 10 integrated into the dust chamber cover 3, via which the filtered exhaust air is expelled. Positioned in a central area of the dust chamber cover 3 is a window 11 of a filter change display.

A carrying recess 12 is molded onto a free edge of the dust chamber cover at an end of the dust chamber cover 3 lying opposite the carrying handle 5. The carrying recess 12 is embodied in the shape of a channel curved outwards, so that four fingers of a hand can reach behind the carrying recess 12. When the four fingers of the hand reach behind the carrying recess 12, with the hand in its normal position the thumb is positioned on the upper side of the dust chamber cover 3. An inventive cover release element 13 is positioned within range of the thumb. The cover release element 13 has an actuating surface 14 which runs at least approximately flush with the surface of the dust chamber cover 3. The cover release element 13 is in the shape of a tongue and is visually separated from the dust chamber cover 3 by a separating gap 15 preferably running in a parabola shape. The cover release element 13 is able to be hinged in a film hinge manner along a chord line 16 between the end points of the parabolic separating gap 15.

The cover release element 13 is clearly shown in FIG. 2 in a perspective view of a section of the dust chamber cover. There is lettering 17 on the actuation surface 14, which indicates to a user that the dust chamber cover 3 is unlocked by pressing the actuation surface 14. Inventively the cover should be able to be released by pressing with the thumb of one hand. The other four fingers of a hand support this cover release movement by the four fingers of a hand gripping the carrying recess from behind the underside of the dust chamber cover 3. To provide a secure hold for the thumb exerting the pressure, the top of the actuation surface 14 is structured so that the thumb cannot slip off. In the exemplary embodiment the surface structure is formed by a plurality of part-spherical nubs 18 which form an uneven surface on the actuation surface 14 so that the thumb is able to grip and is reliably prevented from slipping off. The cover release element 13 is connected to the dust chamber cover 3 by direct molding-on. The bending axis around which the cover release element 13 is able to be hinged and to be pressed inwards runs essentially along the chord line 16. The thickness of the material can be thinned out along the chord line 16 to form a film hinge. If the material is suitably elastic, such as ductile plastic for example, for cover release element 13 and dust chamber cover 3, a hinge-type pivoting can also be possible with a constant wall thickness, without needing a film hinge-type thinning out.

FIG. 3 shows a perspective view from below of a section of the dust chamber cover 3 with integrated cover release element 13. The rear side of the carrying recess 12 is in the foreground. The carrying recess 12 features a plurality of ribs 19 which serve to reinforce the carrying recess curved into the shape of a channel. Molded onto the underside of the cover release element 13 are two opposing inner lugs 20 aligned in parallel to each other, which form two projections 21 perpendicular to the inner surface of the cover release element 13 pointing inwards. On the side of the chord line 16 lying opposite the separating gap 15 a clip element 22 is molded onto the inner side of the dust chamber cover 3. The clip element 22 has an almost rectangular wall section 23, which is molded with its one side edge onto the inner surface of the dust chamber cover 3. The end section 23 protrudes at right angles from the inner surface of the dust chamber cover 3. Molded-on at the free end of the wall section 23 are two channel-shaped teeth 24 which form clip hooks 25 of the clip element 22. Each of the two clip hooks 25 is connected via a bar 26 with one of the inner flaps 20. Between inner flap 20 and wall section 23 a free gap 27 is produced underneath the bar 26 which maintains a bending elasticity of the clip element 22 despite connection to the inner flaps 20. Outside the contour of the separating gap 15 two outer flaps 28 running in parallel to the inner flap 20 are molded onto the dust chamber cover 3. The outer flaps 28 project essentially at right angles from the inner surface of the dust chamber cover 3. In a closed position of the dust chamber cover 3 on the housing 2 side edges 29 of the outer lugs 28 lie against a retaining wall 30 in the vicinity of a counter-clip element 31 against the housing 2.

A perspective view of a section of the housing 2 with the molded-on counter-clip element 31 is shown in FIG. 4. The counter-clip element 31 is molded onto the upper side of the housing 2 and is formed by a dome 32, which is shaped into a ramp and at the upper free end of which a counter-clip hook 33 is molded on so as to project. In a closed position of the dust chamber cover 3 the tooth 24 or the teeth 24 engage with the cut-away back of the counter-clip hook 33. Arranged below the counter-clip hook 33 is an essentially cuboid support block 34. The support block 34 is molded onto the surface of the housing 2 and is cut out in a center area below the counter-clip hook 33 to form a locating pocket 35. In the closed position of the dust chamber cover 3 the free end of the clip element 22 i.e. the teeth 24 or the clip hook 25, fit into the locating pocket 35. By means of two opposite walls 36 of the locating pocket 35 the clip element 22 is guided and centered such that side edges of the wall section 23 of the clip element 22 lie against the inner walls 36 when the dust chamber cover 3 is closed. Retaining walls 30 are embodied into a front area of the support block 34, against which the side edges 29 of the outer lugs 28 lie in the closed position of the dust chamber cover 3.

A part view through the housing 2 and the dust chamber cover 3 with the inventive clip element 22 and the inventive counter-clip element 31 is shown in FIG. 5 in the closed position of the dust chamber cover 3. Also shown in this view are one of the inner flaps 20 and one of the outer flaps 28. The counter-clip hook 33 engages in the closed position of the dust chamber cover 3 over the teeth 24 of the clip hook 25 and in this way keeps the dust chamber cover in its closed position. This latching also ensures that when the vacuum cleaner is carried using the carrying recess 12 the dust chamber cover 3 is not opened inadvertently. The opposing position and orientation of counter-clip hook 33 and clip hook 25 is selected so that with a gravitational force induced by carrying the cleaner by the carrying recess 12 no release of the clip connection can occur, but instead this force leads to an stronger engagement between the counter-clip hook 33 and clip hook 25, increasing the strength and reliability against release.

A part section view through housing 2 and dust chamber cover 3 in a plane offset from clip element 22 and counter-clip element 31 as depicted in FIG. 5 is shown in FIG. 6.

This sectional view shows how the side edge 29 of an outer flap 28 lies against the retaining wall 30 of the support block 34. This adjacency to the side edge 29 to the retaining wall 30 means that the dust chamber cover 3 is additionally fixed such that a movement of the dust chamber cover is prevented which could have caused the clip hook 25 or the teeth to be shaken out of the counter-clip hook. This provides increased security against release of the cover locking.

The invention claimed is:

1. A vacuum cleaner with a housing, in which a dust collection chamber is arranged, which is able to be closed by a dust chamber cover on which a cover release element for a clip element is provided which interoperates with a counter-clip element of the housing to hold the dust chamber cover in a closed position, wherein the cover release element is integrated flush into the contour of the dust chamber cover and is to be released by pressing it, wherein the cover release element is embodied in one piece with the dust chamber cover, and wherein the cover release element forms a movable actuation tongue molded onto the dust chamber cover to leave a separating gap running over a part of an area between the cover release element and the dust chamber cover.

2. The vacuum cleaner as claimed in claim 1, wherein the actuation tongue is pivotable around a base line in the transition area between the cover release element and the dust chamber cover.

3. The vacuum cleaner as claimed in claim 2, wherein the transition area includes a film hinge.

4. The vacuum cleaner as claimed in claim 1, wherein the clip element is arranged on a side of the transition area lying opposite the actuation tongue on the inner side of the dust chamber cover and is able to be actuated by at least one projection on the inner side of the actuation tongue.

5. The vacuum cleaner as claimed in claim 4, wherein the clip element is connected by a bar to the at least one projection.

6. The vacuum cleaner as claimed in claim 4, further comprising two projections formed by walls arranged in parallel to one another, the counter-clip element of the housing being disposed between the two projections in a closed position of the dust chamber cover.

7. The vacuum cleaner as claimed in claim 1, wherein the dust chamber cover includes a handle section for carrying the vacuum cleaner by hand, the handle section extending between a free edge of the dust chamber cover and the cover release element.

8. The vacuum cleaner as claimed in claim 1, wherein the dust chamber cover includes at least one projection with a side edge which lies against a retaining wall of the housing in a closed position of the dust chamber cover.

9. A vacuum cleaner comprising: a housing having a counter-clip element; a dust collection chamber disposed within the housing; and a dust chamber cover for closing the dust collection chamber and having a cover release element with a clip element engaging the counter-clip element of the housing to hold the dust chamber cover in a closed position, the cover release element being integrated flush into the contour of the dust chamber cover and being releasable by a pressing action, wherein the cover release element is embodied in one piece with the dust chamber cover, and wherein the cover release element forms a movable actuation tongue molded onto the dust chamber cover to leave a separating gap running over a part of an area between the cover release element and the dust chamber cover.

10. The vacuum cleaner as claimed in claim 9, wherein the actuation tongue is pivotable around a base line in the transition area between the cover release element and the dust chamber cover.

11. The vacuum cleaner as claimed in claim 10, wherein the transition area includes a film hinge.

12. The vacuum cleaner as claimed in claim 10, wherein the clip element is arranged on a side of the transition area lying opposite the actuation tongue on the inner side of the dust chamber cover and is able to be actuated by at least one projection on the inner side of the actuation tongue.

13. The vacuum cleaner as claimed in claim 12, wherein the clip element is connected by a bar to the at least one projection.

14. The vacuum cleaner as claimed in claim 13, further comprising two projections formed by walls arranged in parallel to one another, the counter-clip element of the housing being disposed between the two projections in a closed position of the dust chamber cover.

15. The vacuum cleaner as claimed in claim 9, wherein the dust chamber cover includes a handle section for carrying the vacuum cleaner by hand, the handle section extending between a free edge of the dust chamber cover and the cover release element.

16. The vacuum cleaner as claimed in claim 9, wherein the dust chamber cover includes at least one projection with a side edge which lies against a retaining wall of the housing in a closed position of the dust chamber cover.

* * * * *